US005564650A

United States Patent [19]

Tucker et al.

[11] Patent Number: 5,564,650

[45] Date of Patent: Oct. 15, 1996

[54] PROCESSOR ARRANGEMENT

[75] Inventors: Christopher J. Tucker, Basildon; George Brown, Benfleet, both of United Kingdom

[73] Assignee: GEC Avionics Limited, Kent, United Kingdom

[21] Appl. No.: 788,546

[22] Filed: Jun. 18, 1985

[30] Foreign Application Priority Data

Jun. 29, 1984 [GB] United Kingdom ..... 8416616

[51] Int. Cl.[6] ..... F41G 7/34; G01C 21/00; G01S 7/00

[52] U.S. Cl. ..... 244/3.17; 342/64; 364/456; 382/278

[58] Field of Search ..... 244/3.17; 342/64; 364/456; 382/199, 278; 348/119

[56] References Cited

U.S. PATENT DOCUMENTS

| | | | |
|---|---|---|---|
| 3,416,752 | 12/1968 | Hembree | 244/3.17 |
| 3,459,392 | 8/1969 | Buynak et al. | 244/3.17 |
| 3,943,277 | 3/1976 | Everly et al. | 244/3.17 |
| 4,162,775 | 7/1979 | Voles | 244/3.17 |
| 4,347,511 | 8/1982 | Hofmann et al. | 342/64 |
| 4,602,336 | 7/1986 | Brown | 364/456 |

FOREIGN PATENT DOCUMENTS

| | | |
|---|---|---|
| 2938853A1 | 4/1981 | Germany . |
| 3011556A1 | 10/1981 | Germany . |
| 2060306 | 4/1981 | United Kingdom . |
| 2072988 | 10/1981 | United Kingdom . |
| 2100955 | 5/1985 | United Kingdom . |
| 2100956 | 5/1985 | United Kingdom . |

OTHER PUBLICATIONS

"Navigation and Homing in Cruise Missiles", Waffentechnik, 10, 1979, pp. 23–25.

"Voltage and Resistance Measuring Apparatus With Automatic Range Switching", Funkschau, 1966, vol. 7 p. 202.

*Primary Examiner*—Michael J. Carone
*Assistant Examiner*—Theresa M. Wesson
*Attorney, Agent, or Firm*—Spencer & Frank

[57] ABSTRACT

A correlation processor arrangement is used to guide an airborne vehicle along a path precisely to a predetermined destination. Guidance is divided into three distinct phases, and during each phase the position of the vehicle is verified by matching the view of its surroundings with stored reference data representing the expected fields of view. During the first navigation phase the stored data consists of predetermined terrain areas. During the second detection phase the destination is acquired, and during the third homing phase the view of the approaching destination is used as the stored reference data.

3 Claims, 1 Drawing Sheet

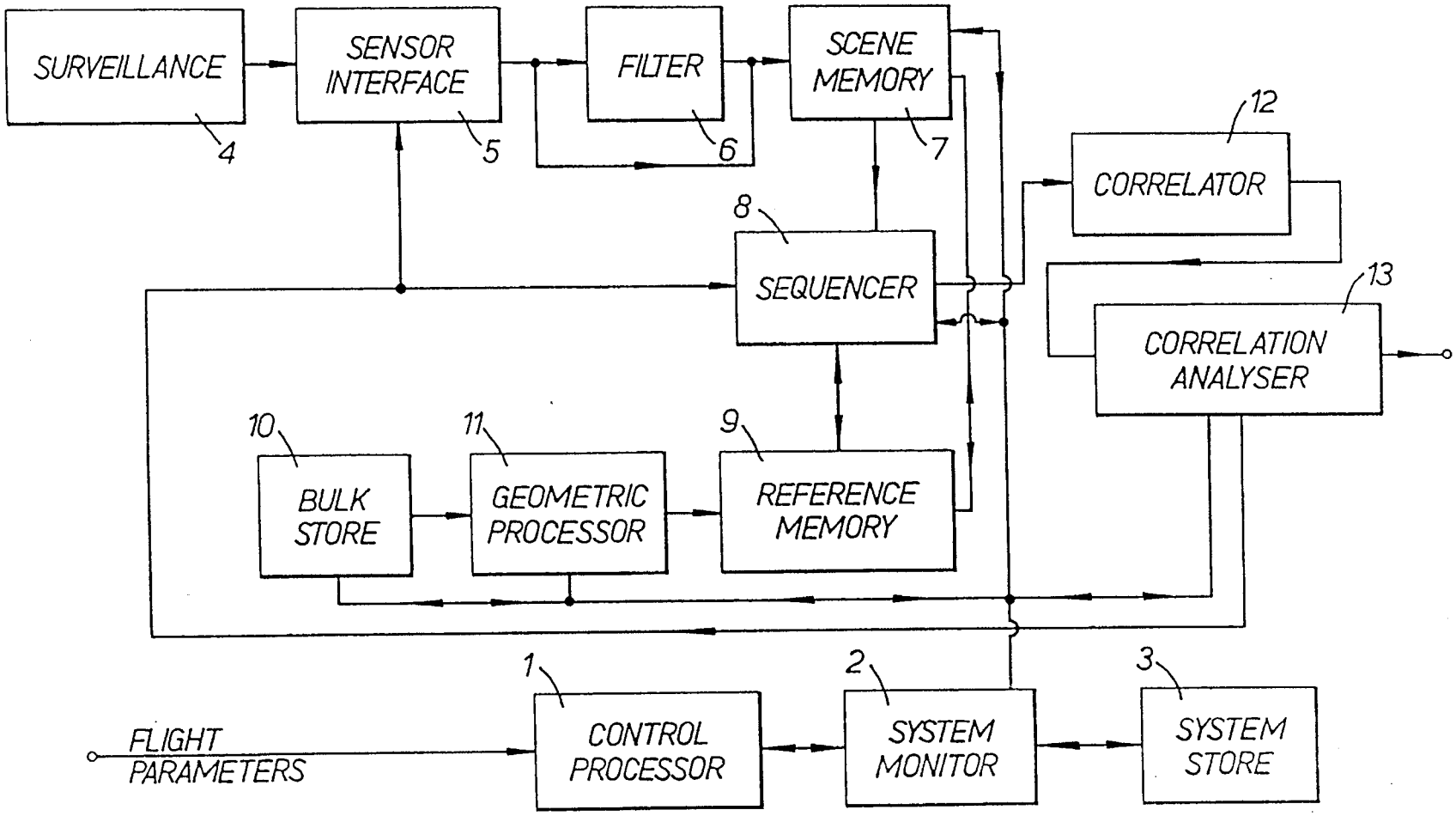
SURVEILLANCE
4
SENSOR INTERFACE
5
FILTER
6
SCENE MEMORY
7
SEQUENCER
8
REFERENCE MEMORY
9
BULK STORE
10
GEOMETRIC PROCESSOR
11
CORRELATOR
12
CORRELATION ANALYSER
13
CONTROL PROCESSOR
1
SYSTEM MONITOR
2
SYSTEM STORE
3
FLIGHT PARAMETERS

PROCESSOR ARRANGEMENT

BACKGROUND OF THE INVENTION

This invention relates to a processor arrangement which is capable of performing different roles using a common hardware structure. The invention is particularly suitable for guiding the passage of a moving body using correlation techniques. Radically different guidance techniques may be used at different stages of guidance, and it has been proposed to use a dedicated control mechanism at each of these different stages. Such an arrangement can be unduly expensive and bulky.

SUMMARY OF THE INVENTION

The present invention seeks to provide an improved processor arrangement.

According to a first aspect of this invention, a correlation processor arrangement for guiding a body includes means operative during a first guidance phase for correlating scene data gathered during movement of the body and which is representative of its viewed surroundings with predetermined stored data which is representative of an expected field of view; said means being operative during a further guidance phase for correlating data gathered during movement of the body with data derived from scene data previously gathered during movement of the body; and means dependent on the position of the body for transferring guidance control from the first phase to the second phase of operation.

According to a second aspect of this invention, a correlation processor for guiding an airborne body along a path, includes means for accepting scene data representative of the viewed terrain over which the body is passing; correlation means operative during a navigation phase to correlate data derived from the scene data with data derived from predetermined stored data representative of terrain scenes over which the body is expected to pass; means utilising the results of said correlation to navigate said body; means for detecting a destination location, and to reconfigure the operation of said correlation means for use during a following homing phase so that said correlation means is operative during the homing phase to correlate data derived from the scene data with scene data gathered-previously during movement of the body along said path; and means utilising the results of correlation performed during the homing phase for guiding the body to said destination.

According to a third aspect of this invention, a correlation processor arrangement for guiding a body along a path towards a destination includes, correlation means operative during a first guidance phase for periodically correlating binary scene data gathered during movement of the body, and which is representative of its surroundings, with predetermined stored binary data which is representative of a portion of an expected field of view; and correlation means operative during a subsequent guidance phase of operation for correlating multi level digital scene data gathered during movement of the body with similar data derived from data gathered previously during movement of the body: and means responsive during an intermediate guidance phase to the detection of the destination in the viewed surroundings for transferring operation of the correlation means from binary data to multilevel data.

The invention is particularly suitable for navigating an airborne vehicle over a relatively long distance to a precisely specified destination along a predetermined path. To achieve this, the movement of the vehicle along the path to its destination is divided into three distinct phases. The first of these phases can be conveniently termed the navigation phase, which is suitable for accurately guiding the vehicle over very long distances. The navigation phase is accomplished by reliance on scene matching correlation techniques; that is to say, the scene of the ground over which the vehicle is flying is compared with stored data carried on board and which corresponds with the terrain over which the vehicle is expected to fly if it maintains its correct course. For this purpose the vehicle carries an optical or infra-red camera or the like to generate video signals representative of the external field of view. By periodically making comparisons between the external scene and the corresponding portion of the onboard data, the actual position of the vehicle is determined and minor corrections to the navigation system can be made so as to hold to the course required to move the vehicle along the predetermined path. This navigation phase continues until the airborne vehicle is sufficiently close to the destination, or target, as it can be conveniently termed, to be able to gather the target within its field of view. Gathering of the target is accomplished during a second phase which is termed a target detection phase.

Once the target has been positively identified, control of the guidance is transferred to the third and final phase, termed the homing phase. In the homing phase, selected fields of view of the identified target are retained as reference data for successively produced fields of view as the body more closely approaches the target. This operation involves a different kind of processing capability since it is necessary to retain the identity of the target as its shape and orientation changes in relation to the field of view as the vehicle approaches and maneuvers relative to it. Clearly during the homing phase a continual and very rapid check on the position of the vehicle is required, even though the data representing the field of view may be relatively small. This is in contrast to the navigation phase in which very large amounts of data representing a large field of view, are processed at relatively infrequent intervals.

BRIEF DESCRIPTION OF THE DRAWINGS

The invention is further described by way of example, with reference to the accompanying drawing FIGURE which illustrates in diagrammatic manner, a processor arrangement in accordance with the invention.

DETAILED DESCRIPTION OF THE PREFERRED EMBODIMENTS

Referring to the drawing, it is assumed that the airborne vehicle is one which measures its own flight parameters, such as altitude, attitude and speed during flight. These parameters are fed into a dedicated control processor 1, the operation of which is determined by a system monitor 2 which utilises a system store 3 in order to influence the flight of the body. The three items, control processor 1, system monitor 2 and system store 3, can be of a fairly conventional nature. The airborne vehicle monitors its field of view typically by means of a video camera surveillance arrangement 4 which produces a processed video signal which is fed via a sensor interface 5 and a filter 6 to a scene memory 7 where it is temporarily stored. Thus data relating to the external scene over which the airborne vehicle is flying is entered periodicially into the scene memory 7 and it is periodically compared under the control of a sequencer 8 with selected data held in a reference memory 9.

Data in the reference memory 9 is extracted from a bulk store 10 as and when it is required. Typically, the bulk store 10 holds all of the possible reference scenes over which the vehicle is likely to fly, and that reference scene which is appropriate to its current position is extracted as and when needed and fed via a geometric processor 11 to the reference memory 9 so that it can be conveniently compared with the corresponding contents of the scene memory 7. The filter 6 modifies the incoming data so as to identify striking geometrical features, such as road junctions, canals, railway lines, estuaries, etc. It achieves this by detecting "edges" in the data pattern—such a filter is described in our United Kingdom patent application No. 8219081, now United Kingdom Patent No. GB2100955B. The geometric processor 11 is present to compensate for the altitude and attitude of the airborne body. It takes the form described in our United Kingdom patent application No. 8219082, now United Kingdom Patent No. GB2100956B. Thus it can compensate for magnification and angular inclination with respect to the terrain over which it is flying so that the data is entered into the reference memory 9 having a magnitude and orientation corresponding to that of the data in the scene memory 7. The degree of similarity between the content of the scene memory 7 and the reference memory 9 is determined by a correlator 12 which feeds its output to an analyser 13 which generates a signal representative of the degree of similarity and assesses the likelihood of the airborne body being in a particular location. The way in which data is organised in an orderly manner so that it can be passed at high speed to the two inputs of the sequencer is as described in our United Kingdom patent application No. 8319210 , corresponding to U.S. patent application Ser. No. 06/643,780.

During this phase, the scene data and the reference data are in binary form, as the amount of data to be handled can be large as it will cover a significant geographical area. Binary data is eminently suitable for identifying distinctive geographical features such as road junctions or railway lines.

During the initial navigation phase, all of the data entered into the scene memory 7 is derived from the video camera system 4. In this way the passage of the airborne vehicle relative to distinctive landmarks can be monitored. Thus the bulk store 10 contains prepared binary data assembled prior to the commencement of the flight relating to distinctive cross-roads, railway junctions, lakes and rivers, and coastline estuaries, etc., in a binary format. Depending upon the speed of the airborne vehicle, the appropriate frames of information are extracted at the appropriate time and entered into the reference memory 9 after modification, to allow for the orientation and height of the airborne vehicle, as previously mentioned. This stored data is then compared with the real time data entered into the scene memory 7. When a portion of the scene memory is found which corresponds with the pre-stored data, the correlation analyser indicates that the current position of the airborne vehicle has been determined.

Any slight positional errors, i.e. deviations from the predetermined path, are compensated by the output of the system so as to slightly alter the direction speed or attitude of the airborne body to direct it towards the next designated reference scene. This process continues, possibly over many hundreds of miles, as the airborne vehicle steadily approaches its predetermined destination. The spacing apart of the locations of the reference scenes is, of course, chosen with regard to the degree of navigational drift which can occur. In each case, the size of reference area and magnitude of the real time field of view as determined by the video signal must be sufficient to allow for this navigational drift, and to permit capture of the current position if it departs slightly from the predetermined flight path.

This process continues until the destination or target is found within the field of view. Thus one of the frames of the bulk store 10 will consist of the representation of the target as viewed by the approaching airborne vehicle. From a knowledge of the planned flight path, and the elapsed time of flight, acquisition of the target is predicted, and the guidance control system operates in its second acquisition, or detection, phase.

The target may comprise a geographical configuration in a manner which is analogous to the data used during the navigation phase, but alternatively the target can be a body or building having a distinctive thermal signature. In this latter case a forward-looking infra-red sensor is used to detect the target. At long range any hot target appears as a point source of heat having a high contrast compared with its surroundings and as such its presence can be highlighted by the use of a suitable filter configuration. Thus the filter 6 can be used to identify a likely target at long range during this second guidance phase. From a knowledge of the estimated position of the target and the attitude of the airborne body, incorrect targets can be excluded to avoid transferring from the navigation phase in response to spurious noise signals resembling a target signature; it is desirable to confirm that the target appears in the same place on successive frames of the optical or thermal sensing system.

Once a target has been detected, guidance control adapts the third phase of operation and the analyser 13 calculates the position of the centre of area of the target, and determines an approach path. During the third phase, termed herein the homing phase, the body must track its own position in relation to the target whilst maneuvering to reach it. To facilitate this, multi level data processing is used in which advantage of grey levels is taken. Video signals representing a large area of the terrain surrounding the target is entered into scene memory 7 from the video surveillance system, and a smaller area also centered on the target aim point is transferred to the reference memory 9 under the control of the sequencer 8. Both sets of video signals are in the multilevel format, and the operation of the sequencer 8 and correlation analyser 13 are much more rapid, as any minor deviations from the required flight path must be very quickly corrected. However, as the size of the scene is relatively very small, this processing can be handled by the same sequencer and correlation analyser quite adequately, even though multi bit data is used. Such an organisation of the correlation process is described in our United Kingdom patent application No. 8319209, corresponding to U.S. patent application Ser. No. 06/643,779 now abandoned.

During this phase the correlation analyser 13 determines target movement relative to the body by detection of the position of the peak of the thermal signature of the target. It advantageously also provides the following functions. (1). To implement a simple predictive filter so that when the target cannot be found by the correlation process within the field of view of the surveillance system, its position is predicted, based on the previous dynamics of the target. (2). To generate an error signal for the guidance system of the airborne vehicle. (3). To determine when the contents of the reference memory 9 are updated by transfer of data from the scene memory 7—this is necessary periodically because as the airborne vehicle gets closer to the target the image grows in the field of view, and if the memory a were not updated, the reference data would look less and less like the real target until it could no longer be tracked. (4). To provide coordinates for the centre of the area to be entered into the scene memory 7 for the subsequent frame of operation.

The error signal obtained under function (2) is fed to the flight control system to modify the flight path The reference update parameters are fed back to the sequencer 8, whilst the predicted or true target position is passed back to the sensor interface 5 to determine the surveillance field of view.

The system monitor 2 acts to supervise the operation of the correlation analyser 13, and its output, and it reconfigures the processor arrangement so that it is adapted to operate sequentially in the three distinct guidance phases which have been described. In this way a relatively few number of processor blocks can be used to provide the different but analogous functions during the flight of the airborne vehicle. Each block is of a relatively simple and straightforward nature, and the main blocks are in any event as desclosed in the previously mentioned patent applications.

We claim:

1. A correlation processor arrangement including means for guiding a body to a destination, said means being operative during a first guidance phase for correlating scene data gathered during movement of the body, and which is representative of surroundings viewed by the body en route to the destination, with predetermined stored data which is representative of an expected field of view, and said means being operative during a further guidance phase for correlating data gathered during movement of the body with data derived from scene data previously gathered during movement of the body; and means dependent on the position of the body for transferring guidance control from the first phase to the second phase of operation.

2. A correlation processor arrangement for guiding an airborne body along a path, including: means for accepting scene data representative of the viewed terrain over which the body is passing; correlation means operative during a navigation phase to correlate data derived from the scene data with data derived from predetermined stored data representative of terrain scenes over which the body is expected to pass; means utilizing the results of said correlation location, to reconfigure the operation of said correlation means for use during a following homing phase so that said correlation means is operative during the homing phase to correlate data derived from the scene data with scene data gathered previously during movement of the body along said path; and means utilizing the results of correlation performed during the homing phase for guiding the body to said destination.

3. A correlation processor arrangement for guiding a body along a path towards a destination including: correlation means operative during a first guidance phase for periodically correlating binary scene data gathered during movement of the body, and which is representative of its surroundings on the way to the destination, with predetermined stored binary data which is representative of a portion of an exchanged field of view, and operative during a subsequent guidance phase of operation for correlating multilevel digital scene data gathered during movement of the body with similar data derived from data gathered previously during movement of the body; and means responsive during an intermediate guidance phase to the detection of the destination in the viewed surroundings for transferring operation of the correlation means from binary data to multilevel data.

* * * * *